US009004745B1

(12) United States Patent
Hajianpour

(10) Patent No.: US 9,004,745 B1
(45) Date of Patent: Apr. 14, 2015

(54) MIXING APPARATUS AND PROCESS

(75) Inventor: Zoya Hajianpour, Fort Lauderdale, FL (US)

(73) Assignee: Zoya, Inc., Fort Lauderdale, FL (US)

( * ) Notice: Subject to any disclaimer, the term of this patent is extended or adjusted under 35 U.S.C. 154(b) by 81 days.

(21) Appl. No.: 13/449,289

(22) Filed: Apr. 17, 2012

(51) Int. Cl.
*B01F 7/04* (2006.01)
*B01F 7/00* (2006.01)

(52) U.S. Cl.
CPC ..... *B01F 7/00016* (2013.01)

(58) Field of Classification Search
CPC ..... B01F 7/00; B01F 7/00008; B01F 7/0009; B01F 7/00191; B01F 7/00233; B01F 7/00391; B01F 7/16; B01F 7/166; B01F 7/24; B01F 15/00; B01F 15/00435; B01F 15/00487; B01F 15/00506; B01F 2015/00; B01F 2015/00077; B01F 2015/00662; B01F 2215/005; B01F 7/1665; A47J 2043/04472; A47J 43/044
USPC ..... 366/241–241, 244–246, 252, 279, 366/283–248, 292, 296, 300, 242, 293, 294
See application file for complete search history.

(56) References Cited

U.S. PATENT DOCUMENTS

| | | | | |
|---|---|---|---|---|
| 948,214 | A * | 2/1910 | Fisher | 366/246 |
| 1,320,881 | A * | 11/1919 | Lomax | 366/296 |
| 4,185,072 | A * | 1/1980 | Puderbaugh et al. | 422/547 |
| 7,537,120 | B1 * | 5/2009 | Cardenas | 206/581 |
| 7,972,056 | B2 | 7/2011 | Lontoc | |

* cited by examiner

*Primary Examiner* — Tony G Soohoo
(74) *Attorney, Agent, or Firm* — Ronald V. Davidge

(57) ABSTRACT

A device mixing ingredients for coloring hair includes a mixing bowl and a housing removably placed atop the mixing bowl so that a pair of agitators rotatably and coaxially mounted within the housing extend downward into the mixing bowl, being driven in opposite directions at the same speed by a mechanism powered by a hand crank, which can be turned in either direction to cause one of the agitators to move a liquid inward within the mixing bowl while the other agitator moves the liquid outward. In an alternative version of the device, the agitators are driven by an electric motor.

14 Claims, 5 Drawing Sheets

MIXING APPARATUS AND PROCESS

RELATED APPLICATIONS

Not Applicable

FEDERALLY SPONSORED RESEARCH OR DEVELOPMENT

Not Applicable

BACKGROUND OF THE INVENTION

1. Field of the Invention

This invention relates to mixing devices and processes, and, more particularly, to such devices and processes for mixing hair coloring materials.

2. Summary of the Background Information

A conventional mixing device includes a mixing bowl and a housing holding an agitator attached to a shaft extending downward into the bowl to be rotationally driven, manually or by means of motor power, with the agitator being formed as a cage extending around and along a lower portion of the shaft. In some such mixing devices, a pair of separate, spaced-apart shafts is provided, each holding an agitator in the form of a cage. The spaced-apart shafts may be geared together to counter-rotate, at the same speed but in opposite directions, with the agitator cages turning together as intermeshed. This type of agitation is particularly effective for thoroughly mixing relatively large batches of materials, such as a mixture to be baking into an entire cake.

U.S. Pat. No. 5,972,043 describes a device for the mixing and application of hair coloring products, which comprises a mixing and application brush with a handle that is attached to a brush portion. The handle is adapted to be received by and work with a rotating hand tool. The brush portion includes a brush base that is generally spatulate in shape and includes at least one mixing aperture. Bristles are also included for applying the mixture to a client's hair. Moreover, a two-piece mixing bowl, having a lower portion and an upper portion is provided. The upper portion of the mixing bowl has an aperture that is designed to receive the handle of the brush and allow the brush to be rotated within the bowl by the hand tool. The brush and mixing bowl may be provided in an convenient kit form and a method for using the same is provided.

U.S. Pat. No. 5,972,043 describes a countertop apparatus dispenses hair coloring, developers and bleach in specified quantities and mixes them. A housing within the apparatus has an upstanding back wall and a bottom wall. A plurality of hair color tube stations is mounted on a forward side of the back wall and a hair color tube squeezing device is positioned at each hair color tube station. The hair color tube squeezing device includes a pair of confronting rollers that engage the trailing end of an inverted hair color tube. A plurality of developer reservoirs and a bleach hopper are also mounted to the apparatus. First and second mixing bowls receive and mix hair coloring and developer at first and second stations, and a third mixing bowl receives and mixes bleach and developer at a third station. Operation of the apparatus is keypad-controlled. An agitator is provided for each mixing bowl. In a first version of the apparatus, each agitator has a conventional, with a vertical shaft descending from an overhead motor downwardly into a mixing bowl, being mounted as necessary so that it can be removed when its mixing bowl is being charged with coloring and developer or with developer and bleach. In a second version of the apparatus, the mixing bowl is provided with a magnetically-operated agitator that sits in the bowl, being rotated by a rotating magnet positioned below bottom wall 10*b*. Such magnetically-operated agitators are commonly known as stir-bars.

SUMMARY OF THE INVENTION

In accordance with a first aspect of the invention, mixing apparatus is provided, including a mixing bowl, a housing, a pair of agitators, and a drive. The mixing bowl has an open top, over which the housing is removably attached to extend. The pair of agitators are each attached to the housing to rotate about a common axis of rotation and to extend downward within the mixing bowl. Each of the agitators includes at least one first mixing surface moving a liquid within the bowl outward when the agitator is rotated in a first direction and at least one second mixing surface moving a liquid within the bowl inward when the agitator is rotated opposite the first direction The mixing surfaces of the pair of actuators are disposed adjacent one another, being spaced apart along the common axis of rotation. The drive, which is operatively connected to each of the agitators, causes the agitators to rotate at a common speed in opposite directions.

Preferably, each of the agitators includes a hub disposed at the common axis of rotation, with the first and second mixing surfaces of each of the agitators spiraling outward along at least one arm from the hub of the agitator. Preferably, the pair of agitators comprises an upper agitator including a tube rotatably attached to the housing and extending downward to the hub of the upper actuator; and a lower agitator including a shaft extending through the tube, to the hub of the lower actuator, and rotating within the tube.

Preferably, the drive comprises a first miter gear, rigidly attached to the tube of the upper agitator; a second miter gear, rigidly attached to the shaft of the upper agitator, and a third miter gear, rotatably attached to the housing, engaging both the first miter gear and the second miter gear, causing the first and second miter gears to rotate in opposite directions. Preferably, the drive additionally comprises a crank causing rotation of the second miter gear, for example with the crank being crank being connected through a drive shaft to a gear meshing with the second miter gear. The crank preferably includes an arm and a knob at an end of the arm, with the arm being attached to the drive shaft to pivot between an open position, in which the knob extends upward from the arm, and a closed position, in which the knob extends downward from the arm, and with the housing including an upper cover having a cavity for accepting the knob as the arm is moved into the closed position. Alternately, drive additionally comprises a motor causing rotation of the second miter gear. The motor may be connected through a drive shaft to a gear meshing with the second miter gear.

In accordance with a second aspect of the invention, mixing apparatus is provided, including a mixing bowel, a housing, a crank, a pair of agitators, and a drive. The housing includes a lower cover, a ring extending downward from the lower cover within a round open top of the mixing bowel to hold the housing in place atop the mixing bowl. The housing additionally includes an upper cover having a truncated spherical surface extending outward beyond the mixing bowel to facilitate moving the housing upward, off the mixing bowl, with finger tips, and a handle, extending outward and downward to facilitate holding the housing. The crank extends outward from the housing, being attached to rotate about a crank axis of rotation. The pair of actuators are each attached to the housing to rotate about a common axis of rotation and to extend downward within the mixing bowl. The drive is operatively connected to each of the agitators, causing the agitators to rotate at a common speed in opposite directions as the crank is rotated. The mixing bowl may include an upper surface having a plurality of slots for holding brushes used to apply a mixture formed within the bowl.

In accordance with a third aspect of the invention, a method is provided for mixing ingredients for coloring hair. The method includes pouring the ingredients into a mixing bowl having an open top, placing a housing including a pair of agitators atop the mixing bowl, causing the pair of agitators to mix the ingredients by rotating in opposite directions, and removing the housing from the mixing bowl to expose the ingredients for application to the hair. Within the housing, the agitators are each attached to rotate about a common axis of rotation and to extend downward within the mixing bowl. Each of the agitators includes at least one first mixing surface moving a liquid within the bowl outward when the agitator is rotated in a first direction and at least one second mixing surface moving a liquid within the bowl inward when the agitator is rotated opposite the first direction. The mixing surfaces of the pair of actuators are disposed adjacent one another, being spaced apart along the common axis of rotation. Preferably, the housing is placed atop the mixing bowl and removed from the mixing bowl by using a handle extending outward from the housing and by holding an edge of an upper cover of the housing extending outward beyond the mixing bowl.

BRIEF DESCRIPTION OF THE FIGURES

These and other aspects of the invention will be made apparent by reading the following specification in conjunction with the accompanying drawings, in which.

DETAILED DESCRIPTION OF THE INVENTION

Figure 1:
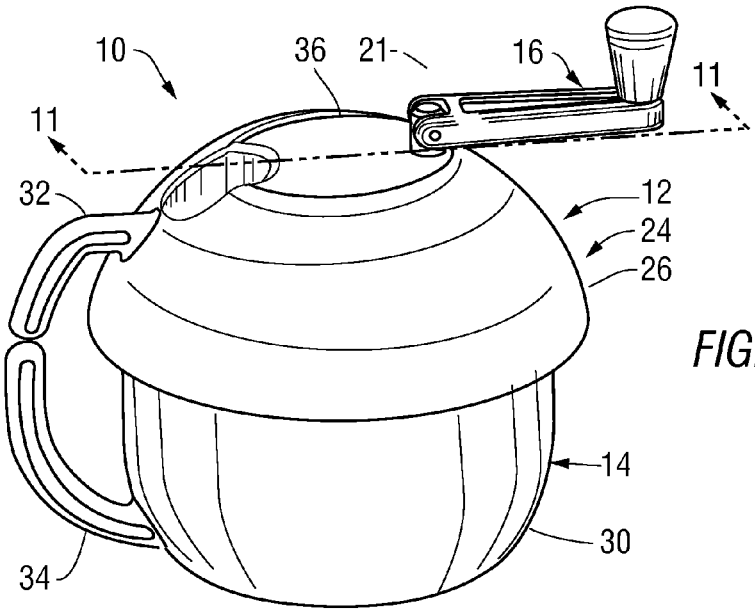
FIG. 1 is a perspective view of mixing apparatus built in accordance with the invention.
Figure 2:
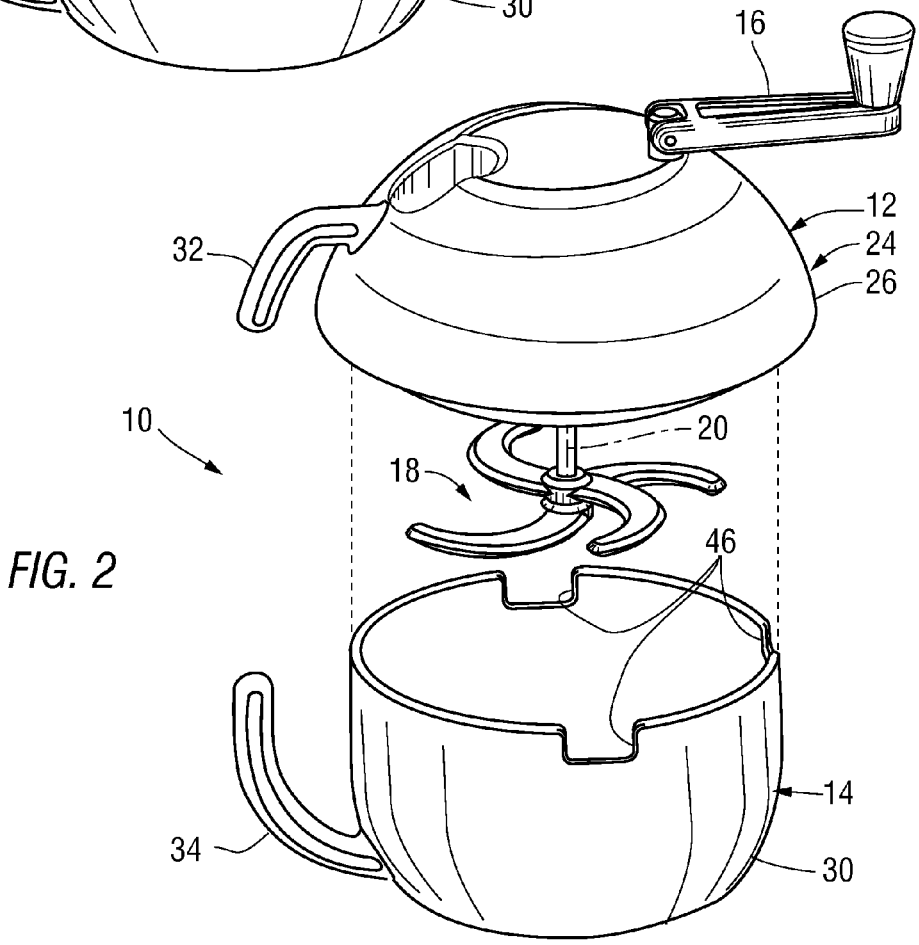
FIG. 2 is a perspective view of a housing within the mixing apparatus of FIG. 1, shown in an exploded relationship with a mixing bowel therein.
Figure 3:
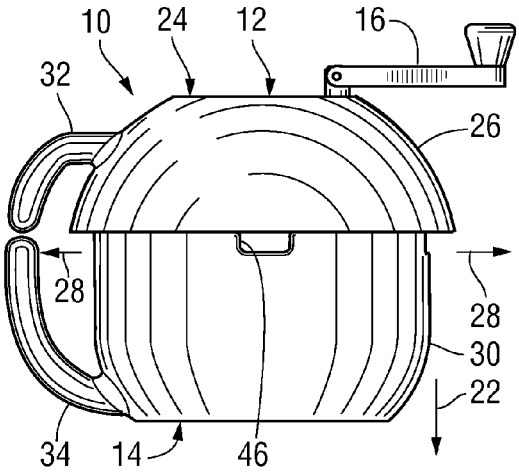
FIG. 3 is a front elevation of the mixing apparatus of FIG. 1.
Figure 4:
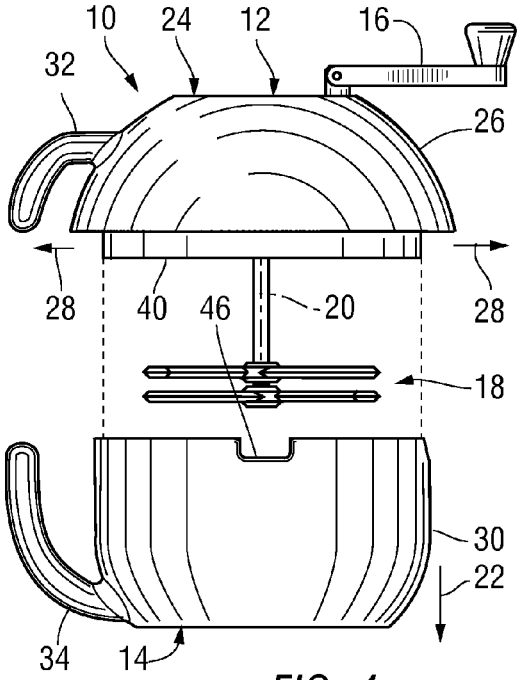
FIG. 4 is a front elevation of the housing within the mixing apparatus of FIG. 1, shown in an exploded relationship with the mixing bowl therein.

FIGS. 1-4 show a mixing device 10 built in accordance with the invention for mixing hair coloring materials, with FIGS. 1 and 2 being perspective views thereof, and with FIGS. 3 and 4 being front views thereof. The mixing device 10 includes a housing 12 and a mixing bowl 14, which are shown together in FIGS. 1 and 3, and separated into an exploded relationship with one another in FIGS. 2 and 4. The mixing device 10 additionally includes a crank 16, extending above the housing 12, and a pair of agitators 18, each attached to the housing 12 to rotate about a common axis 20. When the crank 16 is rotated about an axis of crank rotation 21, the agitators 18 rotate at the same speed as one another, but in opposite directions, about the common axis 20. When the housing 12 is placed atop the mixing bowl 14, as shown in FIGS. 1 and 3, the agitators 18 extend downward, in the direction of arrow 22, into the mixing bowl 14.

Figure 5:
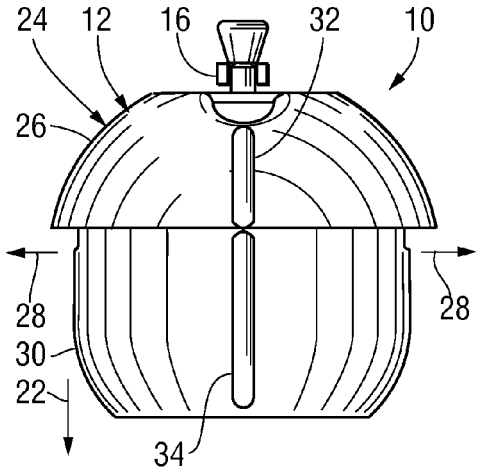
FIG. 5 is a left elevation of the mixing apparatus of FIG. 1.
Figure 6:
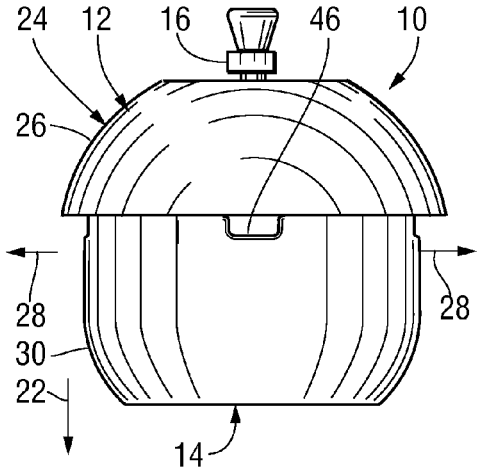
FIG. 6 is a right elevation of the mixing apparatus of FIG. 1.

FIGS. 5 and 6 are elevations of the mixing device 10, with FIG. 5 showing a left side thereof while FIG. 6 shows a right side thereof. The housing 12 is seen to include an upper cover 24 having a truncated spherical surface 26, extending outward, in the directions of arrows 28, beyond the adjacent surface 30 of the mixing bowl 14 by a distance sufficient to facilitate lifting the housing. For example, when the housing 12 is placed atop the mixing bowl 14, the truncated spherical surface 26 extends beyond the adjacent surface 30 of the mixing bowl 14 by a distance in the range of 4-10 mm. The handling of the housing 12 is further facilitated by the provision of a handle 32 extending outward from the upper cover 24 and downward. The handling of the mixing bowl 14 is facilitated by the provision of a handle 34 extending outward from the bowl surface 30 and upward, opposite the direction of arrow 22.

Figure 7:
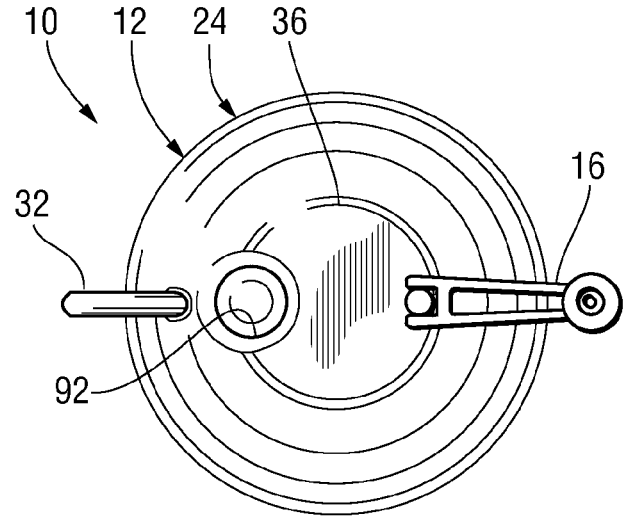
FIG. 7 is a plan view of the mixing apparatus of FIG. 1
Figure 8:
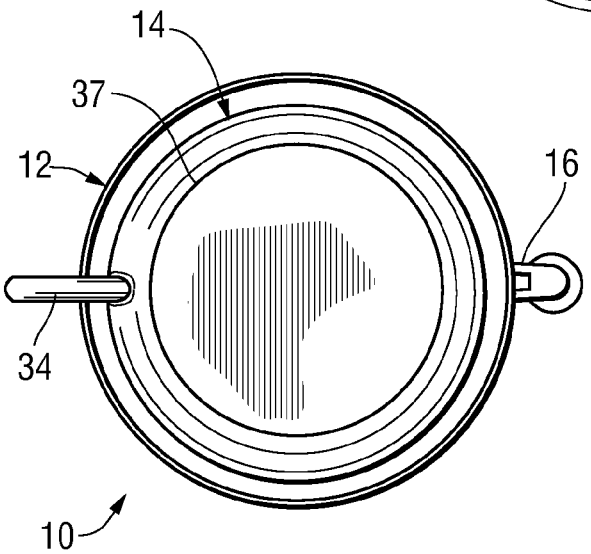
FIG. 8 is a bottom plan view of the mixing apparatus of FIG. 1.

FIG. 7 is a plan view of the mixing device 10, showing a flat surface 36 extending across a central part of the upper cover 24 of the housing 12 to provide clearance allowing rotation of the crank 16. FIG. 8 is a bottom plan view of the mixing device 10, showing a flat lower surface 37, upon which the mixing device 10 rests.

Figure 9:
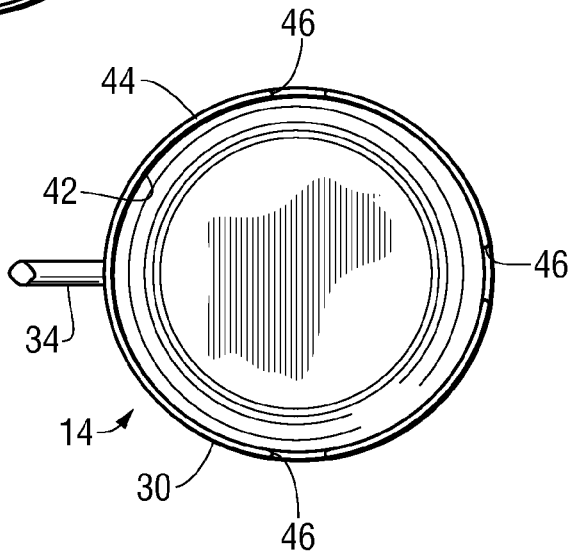
FIG. 9 is a plan view of the mixing bowl within the mixing apparatus of FIG. 1.
Figure 10:
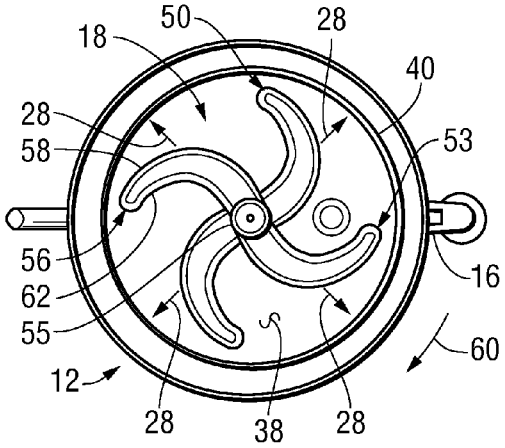
FIG. 10 is a bottom plan view of the housing within the mixing apparatus of FIG. 1.

The means provided for removably attaching the housing 12 to the mixing bowl 14 will now be discussed, with reference being made to FIGS. 9 and 10. FIG. 9 is a plan view of the bowel 14, while FIG. 10 is a bottom plan view of the housing 12. The housing 12 is seen as including a lower cover 38 from which a ring 40 extends downward into the round open top 42 of the mixing bowl 14 when the housing 12 is placed atop the mixing bowl 14, as shown, for example, in FIGS. 5 and 6, to be held in place by gravity. Since both the round open top 42 and the ring 40 are circular, the housing 12 can be placed on the mixing bowl 14 at various angles about the common axis 20, which forms the axis of the ring 40. It is therefore possible to place the housing 12 on the mixing bowl 14 so that the handles 32, 34 are aligned with one another to facilitate handling the housing 12 and the mixing bowl 14 together. FIG. 9 additionally shows an upper surface 44 of the mixing bowl 14, which includes three open slots 46 for holding brushes (not shown) which may be used to apply a mixture formed within the mixing bowl 14.

Figure 11:
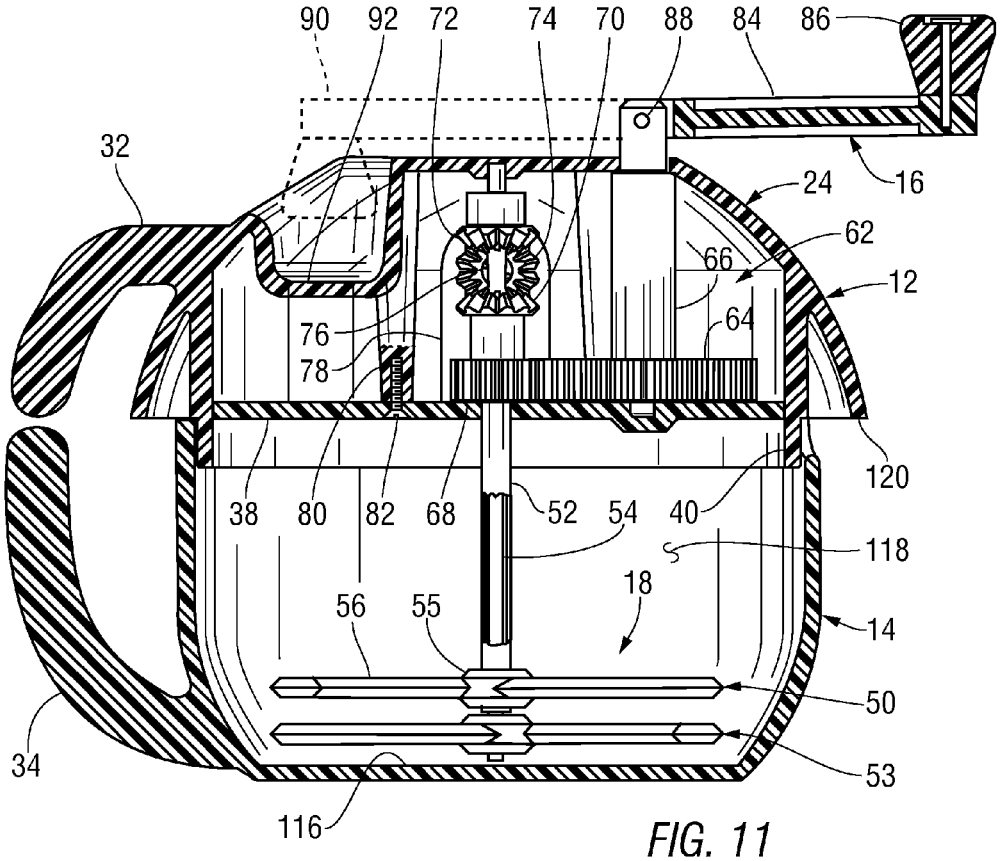
FIG. 11 is a cross-sectional front elevation of the mixing apparatus of FIG. 1, taken as indicated by section lines 11-H therein.

Various aspects of the pair of agitators 18 and of a drive mechanism causing rotation of the rotation of the agitators 18 to occur as a result of rotation of the crank 16 will now be discussed with continued reference being made to FIG. 9, and with additional reference being made to FIGS. 10 and 11. FIG. 10 is a bottom plan view of the housing 12, while FIG. 11 is a cross-sectional front elevation of the mixing device 10, taken as indicated by section lines 11-11 in FIG. 1.

The pair of agitators 18 comprise an upper agitator 50, including a tube 52 rotatably attached to the lower cover 38 within the housing 12, and a lower agitator 53, including a shaft 54, rotating within the tube 52. The shaft 54 extends upward to be rotatably mounted in the upper cover 24 of the housing 12. Each of the agitators 18 additionally includes a hub 55 and two arms 56 extending outward from the hub 54 in a spiral forming a first mixing surface 58, which moves a liquid within the mixing bowl 14 outward, in the directions of arrows 28, as the agitator 18 is rotated in the direction of arrow 60, and a second mixing surface 62 which moves the liquid inward, opposite the directions of arrows 28, as the agitator 18 is rotated opposite the direction of arrow 60. Thus, whenever the two actuators 18, having identical arms 56, are rotated at the same speed in opposite directions, a liquid held within the mixing bowl 14 is moved outward by one of the actuators 18 and inward by the other actuator 18, producing thorough mixing of the liquid regardless of the direction in which the crank 16 is turned.

A drive mechanism 62 connects the crank 16 to the agitators 18 in a manner causing the agitators 18 to rotate at the same speed in opposite directions regardless of the direction in which the crank 16 is rotated. Specifically, the crank 16 and a drive gear 64 are attached to a drive shaft 66 to rotate together. The drive gear 64 engages a driven gear 68, which is rigidly connected to the tube 52 of the upper actuator 50 and to a first miter gear 70. A second miter gear 72 is rigidly connected to the shaft 54 extending upward as a part of the lower agitator 53. A third miter gear 74, which is rotatably mounted to the lower cover 38, engages both the first miter gear 70 and the second miter gear 72, so that these miter gears 70, 72 turn in opposite directions. For example, the three miter gears 70, 72, 74 are the same number of teeth, with the third miter gear 74 rotating on the shoulder portion of a shoulder screw 76 attached to a block 78 extending upward from the drive plate 38. The drive mechanism 62 is held in place within the housing 12 by the attachment of a number of stand-off members 80, extending downward as part of the upper cover 34 to the drive plate 38 by means of screws 82.

Preferably, the crank 16 includes an arm 84, to which a knob 86 is rotatably attached, with the arm 84 being pivotally attached to the drive shaft 66 by a pin 88, allowing the crank 16 to be pivoted between an open position, in which it is shown and in which the crank 16 can be rotated, and a closed position, indicated by dashed lines 90, in which the knob 86 extends downward into a cavity 92 within the upper cover 24.

Figure 12:
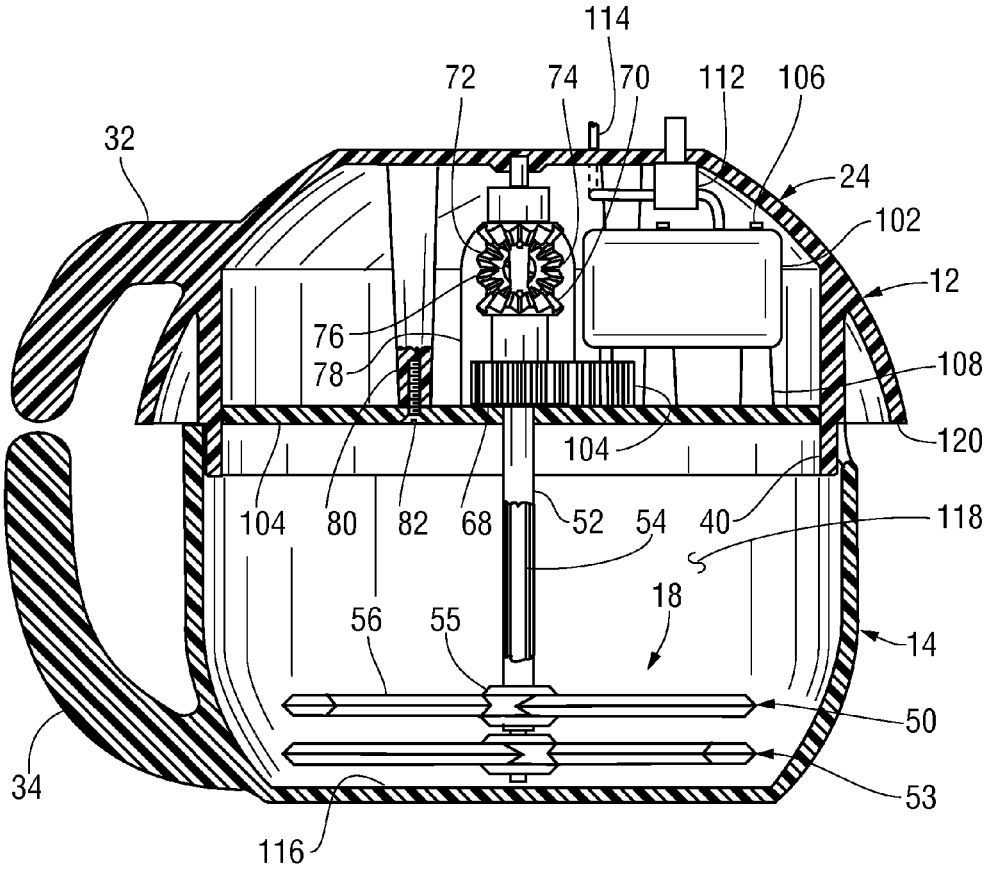
FIG. 12 is a cross-sectional front elevation of mixing apparatus built in accordance with an alternative embodiment of the invention.

FIG. 12 is a cross-sectional front view of a alternative mixing device 100 built in accordance with an alternative embodiment of the invention to include a motor 102 causing the agitators 18 to rotate at the same speed in opposite directions. Elements of the alternative mixing device 100 that are similar to element within the mixing device 10 are accorded like reference numbers. For example, the motor 102 is a gearmotor, fastened to a drive plate 104 by screws 106 extending into stand-off members 108, driving an output gear 110, which engages the driven gear 68. A switch 112 is provided to turn electrical power from a line cord 114 to the motor 102 off and on. In the alternative mixing device 100, various features of the mixing device 10, shown in FIG. 11, and associated with the crank 16 have been eliminated, including the crank 16, the drive shaft 66, the drive gear 38, and the cavity 92, have been eliminated. Other features of the alternative mixing device are as described above regarding the mixing device 10.

The mixing device 10 and the alternative mixing device 100 are each configured to provide for the mixing of a preparation to color a single head of hair. Preferably, the agitators 18 are low enough and close enough to the inner bottom surface 116 of the mixing bowl 14 that both the agitators 18 are covered by such a preparation. The agitators 18 have a particular advantage in this regard over the cage-type agitators of prior art mixing devices. Furthermore, an additional volume is provided in the space 118 within the mixing bowl 14 above the agitators 18, so that a preparation large enough to color long hair can be mixed.

The process of using either the mixing device 10 or the alternative mixing device 100 begins with the housing 12 removed from the mixing bowl 14, as suitable amounts of the materials to be mixed are added to the space 118 within the mixing bowl 14. For example, such materials include one or more liquid dyes and a bleach in a powder form. Next, the housing 12 is placed atop the mixing bowl, to be held in place by the ring 40 extending down into the mixing bowl 114. Then, the agitators 18 are caused to rotate in opposite directions, as explained above, for a suitable time, either by turning the crank 16 of the mixing device 10 or by turning on the motor 102 of the alternative mixing device 100. Then, the housing 12 is removed from the mixing bowl 120, preferably by lifting the housing 12 using the housing handle 32 and the lower edge 120 of the upper cover 24 of the housing 12. Next, the mixed preparation is applied to the hair from the mixing bowl 14 with one or more brushes (not shown). When the brushes are not in use, they may be rested within the slots 46 within the mixing bowl.

While the invention has been described in terms of preferred embodiments with some degree of particularity, it is understood that this description has been given only by way of example, and that many changes can be made without departing from the spirit and scope of the invention, as defined in the appended claims.

What is claimed is:

1. Mixing apparatus comprising:

a mixing bowl having an open top and a and a central lower portion having a flat inner surface;

a housing, removably attached to extend over the open top of the mixing bowl, a pair of agitators, comprising an upper agitator including a tube rotatably attached to the housing, a lower agitator including a shaft extending upward within and beyond the tube, attached to rotate within the tube, wherein each of the agitators additionally includes a central hub pair of arms extending outward from opposite sides of the hub, with each of the arms including spaced-apart upward and downward facing flat surfaces extending between a pair of spirally curved mixing surfaces extending outward from the hub, including first and second mixing surfaces, each spirally curved in a common direction while extending outward from the central hub, and a drive, operatively connected to each of the agitators, causing the agitators to rotate at a common speed in opposite directions.

2. The mixing apparatus of claim 1, wherein the drive comprises:

a first miter gear, rigidly attached to the tube of the upper agitator;

a second miter gear, rigidly attached to the shaft of the lower agitator, and a third miter gear, rotatably attached to the housing, engaging both the first miter gear and the second miter gear, causing the first and second miter gears to rotate in opposite directions.

3. The mixing apparatus of claim 2, wherein the drive additionally comprises a crank causing rotation of the first miter gear.

4. The mixing apparatus of claim 3, wherein the drive additionally comprises a drive shaft connected to the crank and to the first miter gear through a meshed pair of gears to drive the first miter gear with rotation of the crank.

5. The mixing apparatus of claim 4, wherein the crank includes an arm and a knob at an end of the arm, the arm is attached to the drive shaft to pivot between an open position, in which the knob extends upward from the arm, and a closed position, in which the knob extends downward from the arm, and the housing includes an upper cover having a cavity for accepting the knob as the arm is moved into the closed position.

6. The mixing apparatus of claim 1, wherein the arms of the lower agitator are spaced apart from, but moved in proximity to, the flat central portion of the mixing bowl, and the arms of the upper agitator are spaced apart from, and moved in proximity to, the arms of the lower agitator.

7. The mixing apparatus of claim 1, wherein all of the arms are identical.

8. Mixing apparatus comprising:

a mixing bowl with a round open top and a central lower portion having a flat inner surface;

a housing including a lower cover, a ring extending downward from the lower cover within the round open top of the mixing bowl to hold the housing in place atop the mixing bowl, an upper cover including a truncated spherical surface extending outward beyond the mixing bowl to facilitate moving the housing upward, off the mixing bowl, with finger tips, and a handle, extending outward and downward to facilitate holding the housing, a crank, extending outward above the housing, attached to the housing to rotate about a crank axis of rotation;

a pair of agitators, each attached to the housing to rotate about a common axis of rotation and to extend downward within the mixing bowl, wherein each of the agitators comprises a centrally disposed hub and a air of arms extending outward from opposite sides of the hub, wherein all arms within the agitators are identical, with each of the arms including spaced-apart upward and downward facing flat surfaces extending between a pair of spirally curved mixing surfaces extending outward from the hub, being spirally curved in a common direction, and wherein each of the upward and downward facing flat surfaces is parallel to the flat inner surface of the mixing bowl; and a drive, operatively connected to each of the agitators, causing the agitators to rotate at a common speed in opposite directions as the crank is rotated.

9. The mixing apparatus of claim 8, wherein each of the agitators includes at least one first mixing surface moving a liquid within the bowl outward when the agitator is rotated in a first direction and at least one second mixing surface moving a liquid within the bowl inward when the agitator is rotated opposite the first direction, and wherein the mixing surfaces of the actuators are disposed adjacent one another, being spaced apart along the common axis of rotation.

10. The mixing apparatus of claim 9, wherein each of the agitators includes a hub disposed at the common axis of rotation, the first and second mixing surfaces of each of the agitators spiral outward along at least one arm from the hub of the agitator; and the pair of agitators comprises an upper agitator including a tube rotatably attached to the housing and extending downward to the hub of the upper actuator, and a lower agitator including a shaft extending through the tube, to the hub of the lower actuator, and rotating within the tube.

11. The mixing apparatus of claim 8, wherein the housing additionally includes a housing handle, extending outward and downward to a housing handle tip, the mixing bowl additionally includes a bowl handle, extending outward and upward to a bowl handle tip, and the housing can be rotated atop the mixing bowl to align the housing handle tip with the mixing bowl handle tip.

12. The mixing apparatus of claim 8, wherein the mixing bowl includes an upper surface having a plurality of slots for holding brushes used to apply a mixture formed within the bowl.

13. The mixing apparatus of claim 8, wherein the arms of the lower agitator are spaced apart from, but moved in proximity to, the flat central portion of the mixing bowl, and the arms of the upper agitator are spaced apart from, and moved in proximity to, the arms of the lower agitator.

14. The mixing apparatus of claim 8, wherein all of the arms are identical.

* * * * *